US010174475B2

(12) United States Patent
Nakazawa et al.

(10) Patent No.: US 10,174,475 B2
(45) Date of Patent: Jan. 8, 2019

(54) ROTARY PRESS-IN STEEL PIPE PILE

(71) Applicant: NIPPON STEEL & SUMIKIN ENGINEERING CO., LTD., Tokyo (JP)

(72) Inventors: Kimihiro Nakazawa, Tokyo (JP); Masatoshi Wada, Tokyo (JP); Masamichi Sawaishi, Tokyo (JP); Sakae Maruyama, Tokyo (JP); Tomoyuki Shohji, Tokyo (JP); Tomonori Yagishita, Tokyo (JP); Takeshi Sawada, Tokyo (JP)

(73) Assignee: NIPPON STEEL & SUMIKIN METAL PRODUCTS CO., LTD., Tokyo (JP)

( * ) Notice: Subject to any disclaimer, the term of this patent is extended or adjusted under 35 U.S.C. 154(b) by 0 days.

(21) Appl. No.: 15/519,043

(22) PCT Filed: Oct. 21, 2015

(86) PCT No.: PCT/JP2015/079694
§ 371 (c)(1),
(2) Date: Apr. 13, 2017

(87) PCT Pub. No.: WO2016/063910
PCT Pub. Date: Apr. 28, 2016

(65) Prior Publication Data

US 2017/0241099 A1 Aug. 24, 2017

(30) Foreign Application Priority Data

Oct. 21, 2014 (JP) ..... 2014-214356

(51) Int. Cl.
*E02D 5/56* (2006.01)
*E02D 7/02* (2006.01)
(Continued)

(52) U.S. Cl.
CPC ..... *E02D 5/28* (2013.01); *E02D 5/44* (2013.01); *E02D 5/56* (2013.01); *E02D 7/22* (2013.01)

(58) Field of Classification Search
CPC ..... E02B 17/027; E02B 3/06; E02B 17/00; E21B 41/08; E02D 13/04; E02D 7/02;
(Continued)

(56) References Cited

U.S. PATENT DOCUMENTS 5,722,498 A * 3/1998 Van Impe ..... E02D 5/36 175/394
6,394,704 B1 * 5/2002 Saeki ..... E02D 5/56 405/231
(Continued)

FOREIGN PATENT DOCUMENTS

CN 1256732 A 6/2000
CN 102966091 A 3/2013
(Continued)

OTHER PUBLICATIONS

International Search Report, issued in PCT/JP2015/079694, PCT/ISA/210, dated Jan. 19, 2016.
(Continued)

*Primary Examiner* — Benjamin F Fiorello
*Assistant Examiner* — Edwin J Toledo-Duran
(74) *Attorney, Agent, or Firm* — Birch, Stewart, Kolasch & Birch, LLP

(57) ABSTRACT

This rotary press-in steel pipe pile includes: a steel pipe; a first blade which is formed in a substantially helical shape on the steel pipe so as to be positioned close to the distal end the steel pipe and in which a first sectorial gap having a central angle is formed in a circumferential direction thereof; and a second blade which is formed in a substantially helical shape on the steel pipe so as to be positioned
(Continued)

close to the rear end of the steel pipe with respect to the first blade and in which a second sectorial gap having a central angle is formed in a circumferential direction thereof. The first sectorial gap of the first blade and the second sectorial gap of the second blade are disposed at positions that do not overlap in a circumferential direction, and the central angle of the second sectorial gap is set to be smaller than the central angle of the first sectorial gap.

11 Claims, 12 Drawing Sheets

(51) Int. Cl.
*E02D 5/28* (2006.01)
*E02D 5/44* (2006.01)
*E02D 7/22* (2006.01)

(58) Field of Classification Search
CPC .... E02D 5/22; E02D 5/02; E02D 5/72; E02D 27/12; E02D 27/20; E02D 11/00; E02D 7/00; E02D 9/00; E02D 13/10; E02D 23/00; E02D 29/063; E02D 27/18; E02D 27/22; E02D 5/56; E02D 7/22; E02D 7/24; E02D 7/18; B63B 21/26; A01G 17/16; E04H 17/26
USPC .... 405/227, 228, 231, 232, 249, 252.1, 253, 405/255
See application file for complete search history.

(56) References Cited

U.S. PATENT DOCUMENTS 7,114,886 B1 * 10/2006 Slemons ..... E02D 5/56 405/253
7,314,335 B2 * 1/2008 Whitsett ..... E02D 5/38 405/233
7,494,299 B1 * 2/2009 Whitsett ..... E02D 5/38 405/251
7,854,451 B2 * 12/2010 Davis, II ..... E21B 17/046 285/404
8,079,781 B2 * 12/2011 Ronnkvist ..... E02D 5/801 405/251
8,443,918 B2 * 5/2013 Massari ..... E02D 7/22 175/323
8,506,207 B2 * 8/2013 Lutenegger ..... E02D 7/22 175/323
8,845,236 B1 * 9/2014 Dosdourian ..... E02D 5/801 175/19
9,598,831 B2 * 3/2017 Lutenegger ..... E02D 5/56
9,869,177 B2 * 1/2018 Meline ..... E02D 5/808
2004/0076479 A1 * 4/2004 Camilleri ..... E02D 5/56 405/252.1
2008/0226398 A1 * 9/2008 Gibberd ..... E02D 5/40 405/223
2008/0302028 A1 * 12/2008 Lewenhoff ..... E02D 5/80 52/157
2013/0343823 A1 * 12/2013 Lin ..... E02D 5/56 405/233
2014/0196955 A1 * 7/2014 Queen ..... E21B 7/005 175/57
2017/0218590 A1 * 8/2017 Raposo ..... E02D 5/00

FOREIGN PATENT DOCUMENTS

JP 2-26634 U 2/1990
JP 6-34041 U 5/1994
JP 8-134904 A 5/1996
JP 8-226124 A 9/1996
JP 10-331156 A 12/1998
JP 2847062 B2 1/1999
JP 11-140869 A 5/1999
JP 3031247 B2 4/2000
JP 2003-64673 A 3/2003
JP 2003-293367 A 10/2003
JP 2004-183378 A 7/2004
JP 3643303 B2 4/2005
JP 2007-63881 A 3/2007
JP 2009-209074 A 9/2009
JP 2011-157780 A 8/2011

OTHER PUBLICATIONS

Notice of Allowance for JP 2014-214356 dated Oct. 20, 2015.
Office Action for JP 2014-214356 dated Jun. 30, 2015.
Written Opinion of the International Searching Authority, issued in PCT/JP2015/079694, PCT/ISA/237, dated Jan. 19, 2016.
Taiwanese Notice of Allowance and Search Report issued in counterpart Taiwanese Application No. 104134391 dated Aug. 9, 2017, together with a partial English translation.
Chinese Office Action and Search Report for counterpart Chinese Application No. 201580056494.8, dated Aug. 1, 2018, with English translation of the Search Report.

* cited by examiner

ROTARY PRESS-IN STEEL PIPE PILE

TECHNICAL FIELD

The present invention relates to a rotary press-in steel pipe pile with helical blades mounted on a distal end of a steel pipe.

The present application claims priority on Japanese Patent Application No. 2014-214356 filed on Oct. 21, 2014, the content of which is incorporated herein by reference.

BACKGROUND ART

In the related art, with respect to a method of driving a rotary press-in steel pipe pile having a helical blade provided at a distal end of a steel pipe into the ground by applying a rotating force to the rotary press-in steel pipe pile, many methods have been proposed. For example, a steel pipe pile described in Patent Document 1 is provided with an drilling edge provided at a lower end of a steel pipe, a lower helical blade provided on the outer periphery of a lower portion of the steel pipe and having an outer diameter of twice the diameter of the pile, and an upper helical blade provided on the proximal end side of the steel pipe. Ground is drilled by the drilling edge, and a soil removal plate for removing drilled soil entered the bottom surface side of each helical blade to the outside of each helical blade is provided.

Further, a rotary press-in steel pipe pile described in Patent Document 2 has a steel pipe having a distal end portion formed in a helical shape, a lower helical blade made by helically forming a substantially circular steel plate larger than the diameter of the steel pipe along the distal end shape of the steel pipe, and an upper helical blade provided on the proximal end side of the steel pipe and made by helically forming a doughnut-shaped steel plate.

Further, in a rotary press-in steel pipe pile described in Patent Document 3, a distal end of a steel pipe is formed in a helical shape, a single blade protrudes to the inside and the outside of a distal end portion of the steel pipe, and the angle between a portion protruding to the outside and a steel pipe main body is made to be an approximately right angle. Further, a sectorial gap is formed in this blade, and thus the movement of soil while rotationally driving the steel pipe pile can be carried out smoothly.

PRIOR ART DOCUMENTS

Patent Documents

Patent Document 1: Japanese Patent No. 2847062
Patent Document 2: Japanese Patent No. 3031247
Patent Document 3: Japanese Patent No. 3643303

DISCLOSURE OF THE INVENTION

Problems to be Solved by the Invention

However, in the rotary press-in steel pipe piles described in Patent Document 1 and Patent Document 2, the lower helical blade is disposed at the distal end side of the steel pipe and the upper helical blade is disposed close to the rear end with respect to the lower helical blade, thereby attaining improvement in a propulsive force while drilling the ground. However, since the distal end portion of the steel pipe pile is blocked or the lower helical blade provided with a small hole close to a circular shape is fixed to the distal end portion, there is a drawback in that drilling resistance is large when the steel pipe pile is rotationally driven into hard ground such as an intermediate stratum or a bearing stratum of the ground.

For this reason, there is a drawback in that an excessive pressing force or rotating force is required to make the steel pipe pile drill into the ground. Further, in order to make the steel pipe pile drill into the ground against resistance, forward rotation and reverse rotation have to be repeatedly performed, which is very time-consuming, and thus there is a problem in which a predetermined drilling depth cannot be secured in a short time.

Further, each of the lower helical blade and the upper helical blade has a substantially circular shape or a substantially ring shape when viewed in a planar view and is formed in a helical shape by being divided into upper and lower portions at a single cut line in a radial direction, and therefore, as shown in FIG. 4B, the drilled soil does not smoothly move through a vertical gap formed in the helical blade while rotationally driving the steel pipe pile into the ground and the drilled soil serves as resistance for obtaining a ground reaction force (subgrade reaction), and thus there is a drawback in that drilling ability (construction ability) is lowered.

Further, in the rotary press-in steel pipe pile described in Patent Document 3, only one blade is installed at the distal end of the steel pipe, and therefore, a propulsive force necessary for rotationally driving the steel pipe pile into the ground is not obtained at the stratum boundary between a weak stratum and a strong bearing stratum of the ground or the like, and thus there is a concern that idling may occur.

The present invention has been made in view of such circumstances and has an object to provide a rotary press-in steel pipe pile which can be smoothly drilled into the ground, and thus exhibits high construction ability and a large support force.

Means for Solving the Problem

According to an aspect of the present invention, a rotary press-in steel pipe pile is provided with: a steel pipe; a first blade which is formed in a substantially helical shape on the steel pipe so as to be positioned close to the distal end the steel pipe and in which a first sectorial gap having a central angle is formed in a circumferential direction thereof; and a second blade which is formed in a substantially helical shape on the steel pipe so as to be positioned close to the rear end of the steel pipe with respect to the first blade and in which a second sectorial gap having a central angle is formed in a circumferential direction thereof, wherein the first sectorial gap of the first blade and the second sectorial gap of the second blade are disposed at positions that do not overlap in a circumferential direction, and the central angle of the second sectorial gap is set to be smaller than the central angle of the first sectorial gap.

According to the present invention, the first blade and the second blade are mounted on the steel pipe, and the first sectorial gap and the second sectorial gap each having a substantially tapered shape (that is, a circular-sectorial shape) are disposed to be shifted from each other so as not to overlap each other in a circumferential direction of a substantially helical shape. Therefore, the areas of the first sectorial gap and the second sectorial gap when viewed from below can be made to be small, and thus a large support force can be realized. Further, while rotationally driving the steel pile into the ground, the soil drilled by each of the first blade and the second blade smoothly moves through each of the first sectorial gap and the second sectorial gap, and thus the construction ability is high. Furthermore, the first sectorial gap and the second sectorial gap are shifted from each other in the circumferential direction, and therefore, the tilting of the rotary press-in steel pipe pile is suppressed while drilling, and thus construction can be performed in a well-balanced manner.

The central angle of the second blade which is located on the proximal end side of the steel pipe is set to be smaller than the central angle of the first blade, and therefore, a large support force can be realized with excellent construction ability secured. However, if the second sectorial gap is not present in the second blade, the drilling resistance is large, and thus the construction ability becomes worse.

Further, the first sectorial gap and the second sectorial gap may be formed at positions substantially spaced in the circumferential direction of the steel pipe.

The first sectorial gap of the first blade and the second sectorial gap of the second blade are disposed at equal intervals in the circumferential direction of the steel pipe, whereby straight advancement at an early stage of drilling is excellent and the steel pile can be smoothly driven into the ground in a short time.

It is preferable that the outer diameter of the second blade be formed to be larger than the outer diameter of the first blade.

The outer diameter of the second blade is made to be larger than the outer diameter of the first blade, whereby a wedge effect is obtained, and thus the pile can be easily drilled into the ground, and the support force increases.

An opening having a smaller diameter than a distal end opening of the steel pipe may be formed in the first blade, and the opening may be formed to communicate with the first sectorial gap.

The opening of the first blade, which communicates with the first sectorial gap, is formed to have a smaller diameter than the distal end opening of the steel pipe, and thus some of the soil intrudes into the steel pipe through the opening while a large amount of the soil is prevented from intruding into the steel pipe while drilling. Therefore, resistance is small and a propulsion speed is improved.

A ring-shaped or disk-shaped blocking member that restricts the introduction of the soil may be mounted inside of the steel pipe.

The blocking member is provided inside of the steel pipe, whereby even if the soil intrudes to the steel pipe through the opening of the first blade, most of the soil is interrupted by the blocking member. Therefore, it is possible to increase the support force. On the other hand, groundwater or the like intrudes into the pipe through the distal end opening before it is completely blocked, and therefore, a buoyant force acting on the rotary press-in steel pipe pile can be reduced.

Effects of the Invention

According to the above aspect of the rotary press-in steel pipe pile according to the present invention, the first sectorial gap of the first blade and the second sectorial gap of the second blade are disposed to be shifted from each other at positions that do not overlap in the circumferential direction, and therefore, the loss areas of the first sectorial gap and the second sectorial gap when viewed from below can be reduced, and thus a large support force can be realized. Further, while rotationally driving the steel pile into the ground, the drilling resistance at the distal end of the first blade and the drilling resistance at the distal end of the second blade are balanced, and furthermore, the drilled soil smoothly move through the first sectorial gap and the second sectorial gap, and thus a large propulsive force is obtained. Therefore, it is possible to simultaneously improve the support force and the construction ability.

EMBODIMENTS FOR CARRYING OUT THE INVENTION

Hereinafter, rotary press-in steel pipe piles according to embodiments of the present invention will be described with reference to the accompanying drawings.

(First Embodiment)

First, a rotary press-in steel pipe pile 1 according to a first embodiment of the present invention will be described with reference to FIGS. 1 to 7C.

Figure 1:
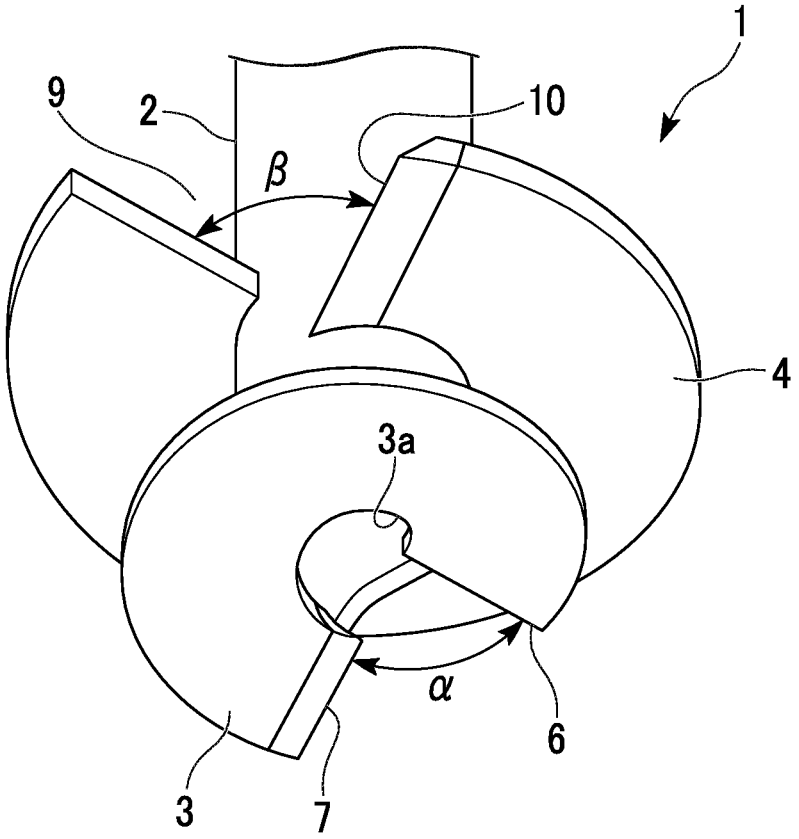
FIG. 1 is a perspective view when a rotary press-in steel pipe pile according to a first embodiment of the present invention is viewed obliquely from below.
Figure 2:
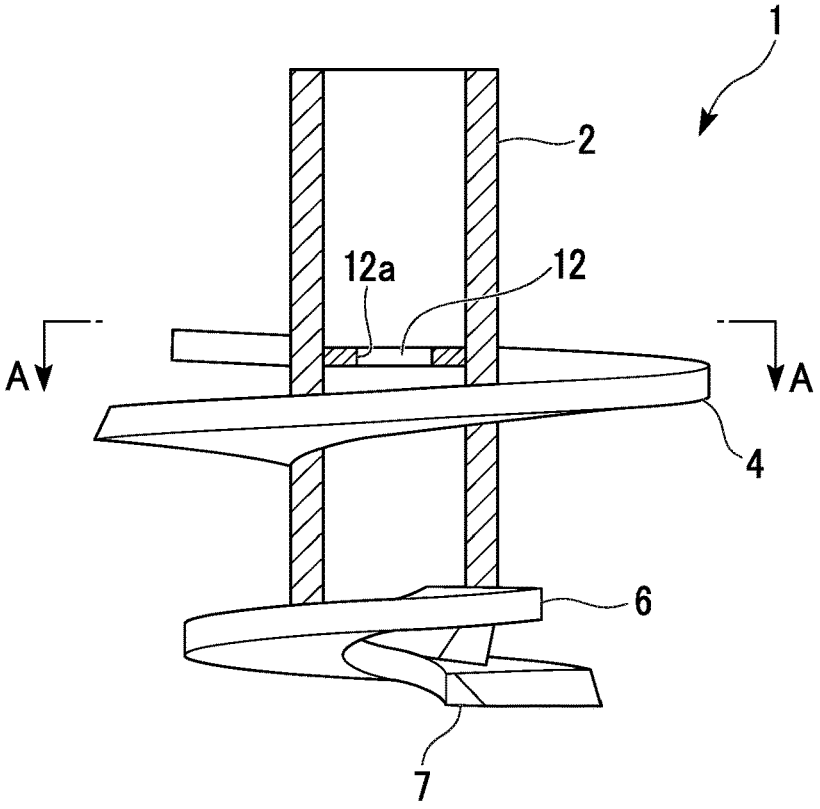
FIG. 2 is a longitudinal sectional view of a main section of the rotary press-in steel pipe pile shown in FIG. 1.
Figure 3:
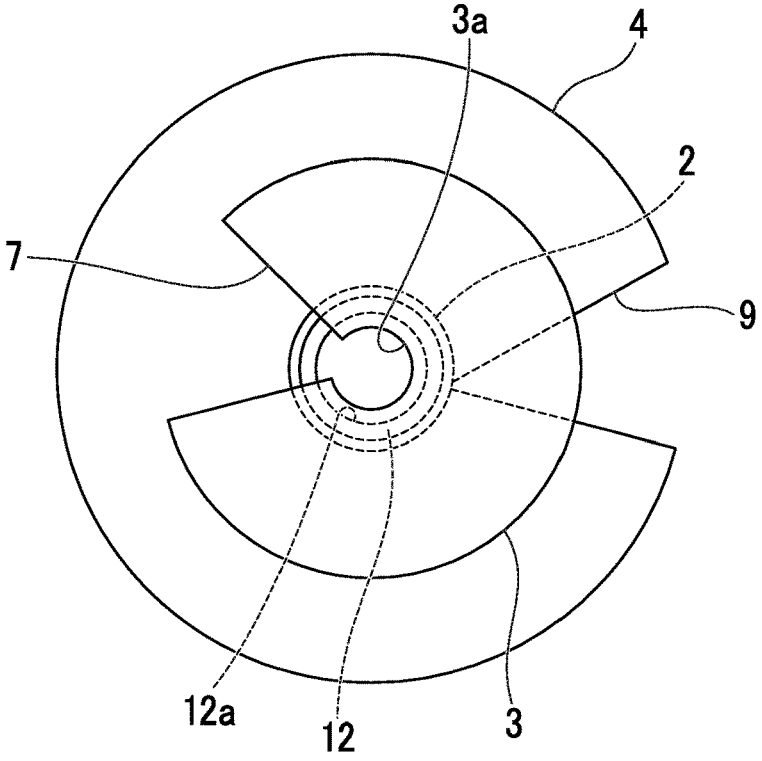
FIG. 3 is a diagram when the rotary press-in steel pipe pile shown in FIG. 2 is viewed from the distal end side.

In the rotary press-in steel pipe pile 1 in the first embodiment, as shown in FIGS. 1 to 3, a distal end surface having a distal end opening of a tubular steel pipe 2 is formed in a helical shape. A lower blade 3 formed in a helical shape is fixed to the distal end surface, and an upper blade 4 is fixed on the steel pipe 2 so as to be positioned close to the proximal end of the steel pipe 2 with respect to the lower blade 3 at a predetermined distance therebetween in a longitudinal direction of the steel pipe 2. As blades which are provided in the longitudinal direction of the steel pipe 2, two blades, the lower blade 3 and the upper blade 4, are installed, whereby a propulsive force can be obtained from both the blades 3 and 4.

Further, three or more blades may be installed in the longitudinal direction of the steel pipe 2, and the lower blade 3 may be fixed to the vicinity of the distal end of the steel pipe 2.

Here, in this specification, the front side in a ground drilling direction of the rotary press-in steel pipe pile 1 and the steel pipe 2 shall be referred to as a distal end or a distal end side, and the opposite side thereof shall be referred to as a proximal end side or a rear end side.

The lower blade 3 is formed in an approximately ring shape when viewed in a planar view, as shown in FIGS. 1 and 3, a part of the lower blade 3 is cut out to form a first sectorial gap 6, and the lower blade 3 is formed in a helical shape as a whole. Further, an inner peripheral edge of the lower blade 3 protrudes to the inside of the distal end opening of the steel pipe 2 and an outer peripheral edge of the lower blade 3 protrudes to the outside of the steel pipe 2, and the lower blade 3 is fixed to the distal end surface of the steel pipe 2 by welding or the like. An opening 3*a* is formed on the inner side of the lower blade 3, and the inner diameter dimension of the opening 3*a* is, for example, about ½ of the outer diameter of the steel pipe 2. The first sectorial gap 6 cut out in a substantially tapered shape (that is, a circular-sectorial shape) toward the outside from the opening 3*a* is formed in the lower blade 3. The first sectorial gap 6 has a central angle α, and both end portions thereof form an upper end portion and a lower end portion in a height direction of the helical shape of the lower blade 3. A cutting edge portion 7 is formed at the lower end portion on the front side in a rotation direction of the first sectorial gap 6.

Figure 4A:
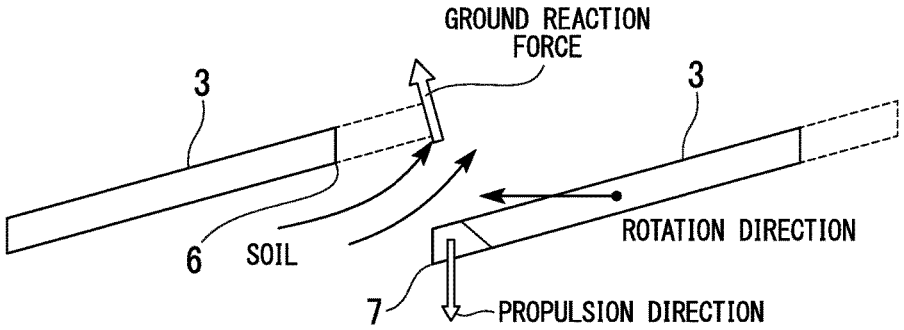
FIG. 4A is an explanatory diagram showing the relationship between a first sectorial gap of a lower blade and a drilling flow of soil while rotationally driving a pile into the ground in the first embodiment.

Here, in the first sectorial gap 6 of the lower blade 3 according to this embodiment, clearance due to the first sectorial gap 6 is formed in the circumferential direction and the height direction, as shown in FIG. 4A, whereby while rotationally driving the pile into the ground, drilling is performed by the cutting edge portion 7, and the soil of the ground is pushed up through the first sectorial gap 6 to propel the lower blade 3 downward. For this reason, the soil smoothly moves through the first sectorial gap 6, and thus drilling resistance decreases. A second sectorial gap 9 of the upper blade 4 also exhibits the same function.

Figure 4B:
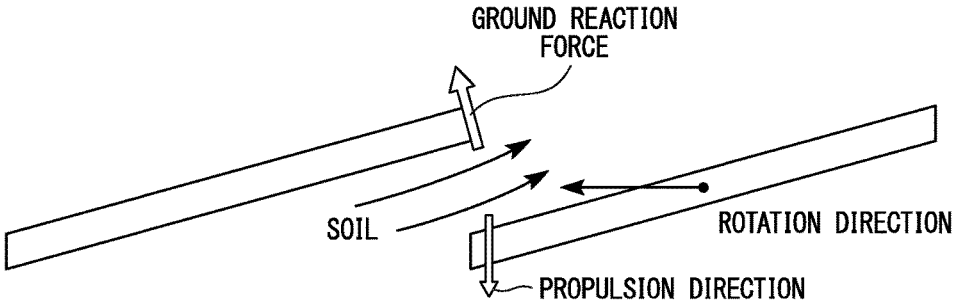
FIG. 4B is an explanatory diagram showing the relationship between a sectorial gap of a lower blade and a drilling flow of soil while rotationally driving a pile into the ground in the related art.

On the other hand, if a central angle spreading in the circumferential direction is not present in a sectorial gap, as in the related art shown in FIG. 4B, the reaction force of the soil of the ground acts on a blade of a terminus portion while drilling the ground, and thus the movement of the soil and propulsion of the pile do not work smoothly.

Further, the upper blade 4 is formed in an approximately ring shape when viewed in a planar view, having an outer diameter larger than the outer diameter of the lower blade 3, for example, a dimension of approximately 1.5 times the outer diameter of the lower blade 3, and a part thereof is cut out at a central angle β in the circumferential direction to form the second sectorial gap 9, and the upper blade 4 is formed in a helical shape as a whole. The outer diameter of the upper blade 4 is set to be larger than the outer diameter of the lower blade 3, whereby the rotary press-in steel pipe pile 1 can obtain a large propulsive force while drilling and easily entered into the ground, and a support force by the upper blade 4 increases.

The inner peripheral surface of the upper blade 4 is fixed to the outer peripheral surface of the steel pipe 2 by welding or the like. Further, the second sectorial gap 9 of the upper blade 4 is formed at a position opposite to the first sectorial gap 6 of the lower blade 3 in the circumferential direction, for example, an opposite position away from the first sectorial gap 6 by approximately 180 degrees in the circumferential direction of the steel pipe 2. The second sectorial gap 9 is also formed to be cut out in a substantially tapered shape (that is, a circular-sectorial shape) at a predetermined central angle β toward the outside from the inside. Both end portions of the second sectorial gap 9 form an upper end portion and a lower end portion in the height direction of the helical shape of the upper blade 4. A cutting edge portion 10 is formed at the lower end portion on the front side in the rotation direction of the second sectorial gap 9.

Further, the first central angle α (or the area thereof) is set to be larger than the second central angle β (or the area thereof). By making the second central angle β of the second sectorial gap 9 smaller than the first central angle α of the first sectorial gap 6, it is possible to increase the support force of the rotary press-in steel pipe pile 1. Further, the first sectorial gap 6 and the second sectorial gap 9 are installed at positions opposite to each other by, for example, about 180 degrees at the lower blade 3 and the upper blade 4, whereby the pile 1 can be smoothly driven into the ground in a short time with a well-balanced drilling reaction force. Further, the tilting of the rotary press-in steel pipe pile 1 of an early time of drilling is suppressed, and thus construction with good quality can be performed in the vertical direction.

Further, the opening 3*a* of the lower blade 3 is open with an inner diameter of ½ of the outer diameter of the steel pipe 2. Further, a blocking plate 12 having a ring shape when viewed in a planar view is formed inside of the steel pipe 2 at an area of the upper blade 4 and fixed to the inner surface of the steel pipe 2 by welding or the like. For this reason, a small hole 12*a* through which groundwater, soil, or the like can pass is formed at the center of the blocking plate 12. Further, in a case where the steel pipe 2 has a small diameter, clogging occurs in the distal end opening, and therefore, the blocking plate 12 may not be provided. However, in a case where the diameter of the steel pipe 2 is large, the distal end opening is not easily clogged with soil, and therefore, the blocking plate 12 is installed, and thereby it contributes to a clogging support force.

If the distal end of the steel pipe 2 is blocked, as in the related art, drilling resistance against the rotary press-in steel pipe pile 1 is large and a buoyant force due to groundwater acts on the steel pipe 2, thereby increasing drilling resistance, and therefore, there is a drawback in that the construction ability is poor. On the other hand, if the whole of the opening of the steel pipe 2 is in a fully opened state, soil introduces to the steel pipe 2, and therefore, there is a drawback in that the support force is reduced. In contrast, in the rotary press-in steel pipe pile 1 according to this embodiment, although some of drilled soil intrude into the steel pipe 2, further intrusion of most of the soil is prevented by the blocking plate 12, and furthermore, since the blocking plate 12 has a helical shape and has the small hole 12*a* at the center, the drilling resistance is small, and a buoyant force due to groundwater can be reduced.

The rotary press-in steel pipe pile 1 according to the first embodiment has the above-described configuration, and next, a construction method thereof will be described.

The rotary press-in steel pipe pile 1 is vertically erected on the ground by a piling machine or the like, and the rotary press-in steel pipe pile 1 is gripped at a head thereof and screwed into the ground while being rotated. Then, the rotary press-in steel pipe pile 1 intrudes into the ground while drilling the ground sequentially by the cutting edge portions 7 and 10 of the lower blade 3 and the upper blade 4 which rotate, and the soil smoothly move to the outer peripheral side of the steel pipe 2 through the first sectorial gap 6 of the lower blade 3 and the second sectorial gap 9 of the upper blade 4, and thus the resistance is small.

Then, the rotary press-in steel pipe pile 1 is propelled into the ground by obtaining a reaction force from the ground.

Further, the first sectorial gap 6 of the lower blade 3 and the second sectorial gap 9 of the upper blade 4 are installed at positions opposite to each other by approximately 180 degrees, and therefore, a drilling load is balanced when the pile is propelled while drilling the ground with the respective cutting edge portions 7 and 10, and thus the rotary press-in steel pipe pile 1 can be easily propelled with it kept vertically. Further, soil is drilled by the cutting edge portion 7 formed at the first sectorial gap 6 of the lower blade 3 and the cutting edge portion 10 formed at the second sectorial gap 9 of the upper blade 4, and the soil smoothly moves through the respective sectorial gaps 6 and 9, and thus the construction ability and propulsion ability are good, and in addition, the cutting edge portions 7 and 10 are provided at positions opposite to each other, whereby an excessive load does not act on the steel pipe 2 and the vertical propulsion ability of the rotary press-in steel pipe pile 1 can be maintained.

As described above, in the rotary press-in steel pipe pile 1 in which the two blades, the lower blade 3 provided with the first sectorial gap 6 and the upper blade 4 provided with the second sectorial gap 9 are installed on the distal end side of the steel pipe 2, a large propulsive force is obtained, compared to a rotary press-in steel pipe pile in which a single blade is installed at the distal end of the steel pipe 2, and therefore, the rotary press-in steel pipe pile 1 can reliably dig the ground from a weak stratum to a strong bearing stratum without idling and can be smoothly constructed into the bearing stratum as well.

Further, the central angle β of the second sectorial gap 9 is set to be smaller than the central angle α of the first sectorial gap 6, and therefore, good construction ability can be secured and in addition, a large support force can be realized by a large pressing force by the upper blade 4. On the other hand, if the second sectorial gap 9 is not provided in the upper blade 4, the construction ability is reduced.

Further, the lower blade 3 and the upper blade 4 provided at the steel pipe 2 are fixed with a predetermined distance therebetween and the upper blade 4 has a shape having a larger diameter than the lower blade 3. For this reason, in the rotary press-in steel pipe pile 1, a large propulsive force is obtained, and therefore, the rotary press-in steel pipe pile 1 can reliably dig the ground from a weak stratum to a strong bearing stratum without idling and can be smoothly constructed into the bearing stratum as well.

Figure 5:
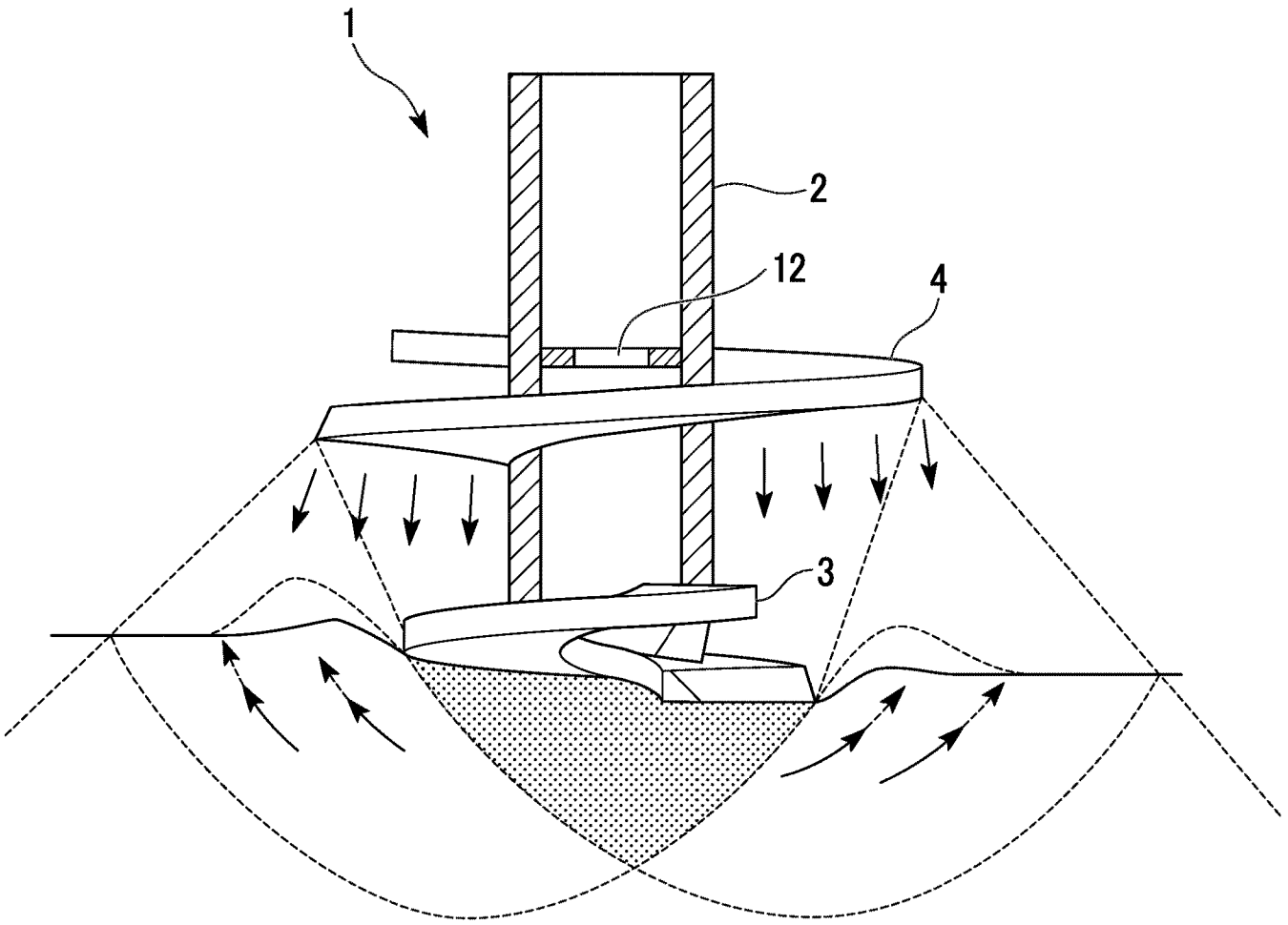
FIG. 5 is an explanatory diagram showing an early state of the rotary press-in steel pipe pile driven into the ground.

Further, as shown in FIG. 5, a wedge effect is obtained due to the combination of the upper blade 4 having an enlarged diameter and the lower blade 3 having a relatively small diameter. In addition, since the soil pushed upward by the outer peripheral side of the lower blade 3 is restrained in movement by the pressing force of the diameter-enlarged upper blade 4 located on the upper side of the lower blade 3 while acting a vertical load on the pile, the lower blade 3 can be reliably supported by the ground. As a result, a large ground support force with respect to the rotary press-in steel pipe pile 1 can be realized.

The rotary press-in steel pipe pile 1 can reliably dig the ground from a weak stratum to a strong bearing stratum through a stratum boundary without idling, and the rotary press-in steel pipe pile 1 is propelled into the bearing stratum in the vertical direction. Further, the central angle β of the second sectorial gap 9 of the upper blade 4 is smaller than the central angle α of the first sectorial gap 6 of the lower blade 3, and thus the area of pressing the ground is large. Therefore, it is possible to increase the support force of the rotary press-in steel pipe pile 1 with respect to the ground.

Further, the opening 3*a* formed in the lower blade 3 at the distal end of the steel pipe 2 is formed in an approximately keyhole shape due to the inner diameter of approximately ½ of the outer diameter of the steel pipe 2 and the first sectorial gap 6 communicating with the outside, and therefore, the soil can introduce to the opening 3*a*. For this reason, the resistance at the distal end of the steel pipe 2 while drilling is small. The soil intruded to the steel pipe 2 is blocked by the blocking plate 12. However, since the blocking plate 12 has a ring shape (or a disk shape or a helical shape) and the small hole 12*a* is formed at the center thereof, the soil can move slightly upward and the drilling resistance is small. Further, even if water discharges from the ground while drilling, since it can flow into the steel pipe 2 through the opening 3*a*, the buoyant force acting on the rotary press-in steel pipe pile 1 is small, and thus the construction performance is not hindered.

EXAMPLES

Hereinafter, Test Examples 1 and 2 performed on Examples 1 and 2 of the rotary press-in steel pipe pile 1 according to the first embodiment of the present invention and Comparative Examples 1 and 2, and the results thereof will be described.

Test Example 1

In Test Example 1, the diameter of the steel pipe 2 of the rotary press-in steel pipe pile 1 used in the test of each of Example 1 and Comparative Example 1 was set to be ϕ190 mm and a construction length was set to be 30.2 m. Further, the configuration of the first embodiment described above was set to be Example 1, and an example in which the second sectorial gap 9 was not provided in the upper blade 4 in Example 1 was set to be Comparative Example 1.

Then, the rotary press-in steel pipe pile 1 was divided into a lower pile, a first intermediate pile, a second intermediate pile, a third intermediate pile, and an upper pile according to the depth, as shown in Table 1, the lower blade 3 and the upper blade 4 were provided at the lower pile of the distal end, drilling was performed sequentially to a required depth, and a construction torque, a construction time, and a support force were measured. The results are shown in Table 1 and the graph of FIG. 6C.

TABLE 1

| | | Length of each pile (m) | Total length of piles (m) | Construction time of each pile (min.) | Total construction time of piles (min.) | Support force of pile (kN) | (ratio) |
|---|---|---|---|---|---|---|---|
| Example 1 (with sectorial gap) | Upper pile | 6.5 | 30.6 | 35 | 125 | About 1100 | 1.00 |
| | Third intermediate pile | 5.8 | | 54 | | | |
| | Second intermediate pile | 5.3 | | 4 | | | |

TABLE 1-continued

| | | Length of each pile (m) | Total length of piles (m) | Construction time of each pile (min.) | Total construction time of piles (min.) | Support force of pile (kN) | (ratio) |
|---|---|---|---|---|---|---|---|
| | First intermediate pile | 5.5 | | 24 | | | |
| | Lower pile | 7.5 | | 8 | | | |
| Comparative Example 1 (without sectorial gap) | Upper pile | 6.5 | 30.6 | 42 | 182 | About 1400 | 1.25 |
| | Third intermediate pile | 5.8 | | 78 | | | |
| | Second intermediate pile | 5.3 | | 8 | | | |
| | First intermediate pile | 5.5 | | 38 | | | |
| | Lower pile | 7.5 | | 16 | | | |

Figure 6A:
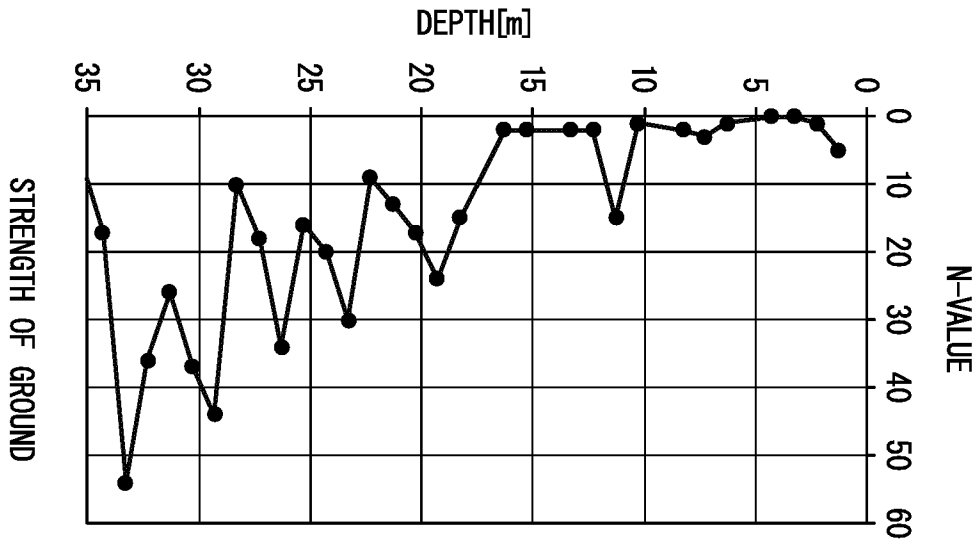
FIG. 6A is a diagram showing the relationship between the depth of the ground and the strength of the ground on which Test Example 1 is carried out.
Figure 6B:
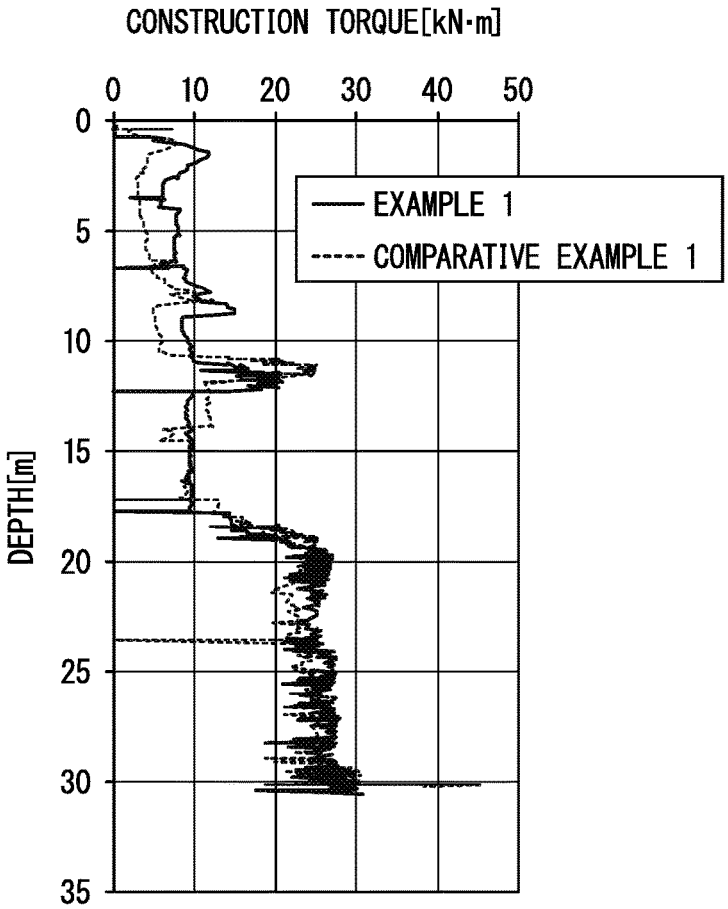
FIG. 6B is a diagram showing a measurement result of a construction torque in Test Example 1 by Example 1 and Comparative Example 1.
Figure 6C:
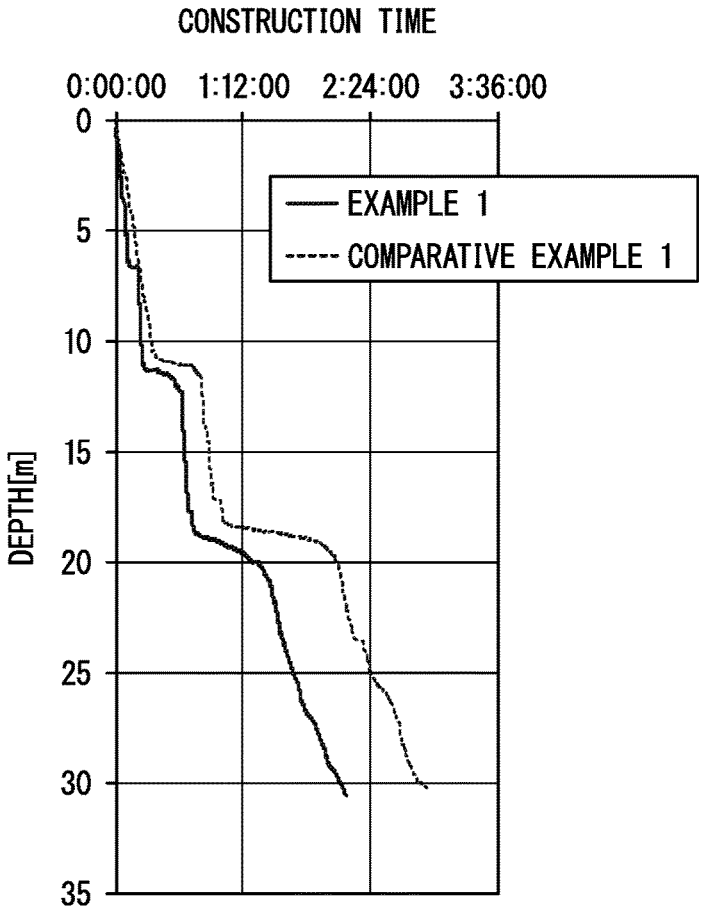
FIG. 6C is a diagram showing a measurement result of a construction time in Test Example 1.

FIG. 6A is a diagram showing ground strength according to a depth based on a ground survey performed in the vicinity of a test pile. Further, FIG. 6B shows the test results showing a construction torque, and the construction torques of Example 1 and Comparative Example 1 are almost equal to each other. FIG. 6C shows a construction time, and at the depth of the ground (for example, a dense sandy ground) where ground strength becomes high, which is at or in the vicinity of a depth of 12 m or 18 m, there is a characteristic in which a construction time increases in Comparative Example 1, compared to Example 1.

Further, from Table 1, a time required for drilling of the rotary press-in steel pipe pile 1 was 125 minutes in Example 1 and 182 minutes in Comparative Example 1, respectively. Further, the support force of the rotary press-in steel pipe pile 1 was about 1100 kN in Example 1 and about 1400 kN in Comparative Example 1, respectively.

From the results of Test Example 1, it was found that although in Comparative Example 1 in which the second sectorial gap 9 was not provided in the upper blade 4, the support force was higher by 1.25 times than in Example 1, in the hard ground having a depth of 12 m or more, the construction time was shorter in Example 1 than in Comparative Example 1, and thus high construction ability could be exhibited. For this reason, in Example 1 in which the second sectorial gap 9 of the upper blade 4 is positioned opposite to the first sectorial gap 6 of the lower blade 3 with respect to the steel pipe 2, the construction ability was high as compared with Comparative Example 1, and in particular, the construction ability in a hard ground was high. Further, the support force was higher in Comparative Example 1 in which a sectorial gap was not provided in the upper blade 4. However, a sufficiently high support force was obtained in Example 1 as well.

Test Example 2

Also in Test Example 2, the diameter of the steel pipe 2 of the rotary press-in steel pipe pile 1 used in each of Example 2 and Comparative Example 2 was set to be ϕ190 mm, and a construction length was set to be 12.5 m. Further, the configuration of the above-described embodiment was set to be Example 2, and an example in which the second sectorial gap 9 of the upper blade 4 was provided to overlap the first sectorial gap 6 of the lower blade 3 was set to be Comparative Example 2.

Then, the rotary press-in steel pipe pile 1 was divided into a lower pile, an intermediate pile, and an upper pile according to the depth, as shown in Table 2, the lower blade 3 and the upper blade 4 were provided at the lower pile, a drilling test was performed sequentially to a required depth, and a construction torque, a construction time, and a support force were measured. The results are shown in Table 2 and the graph of FIG. 7C.

Figure 7A:
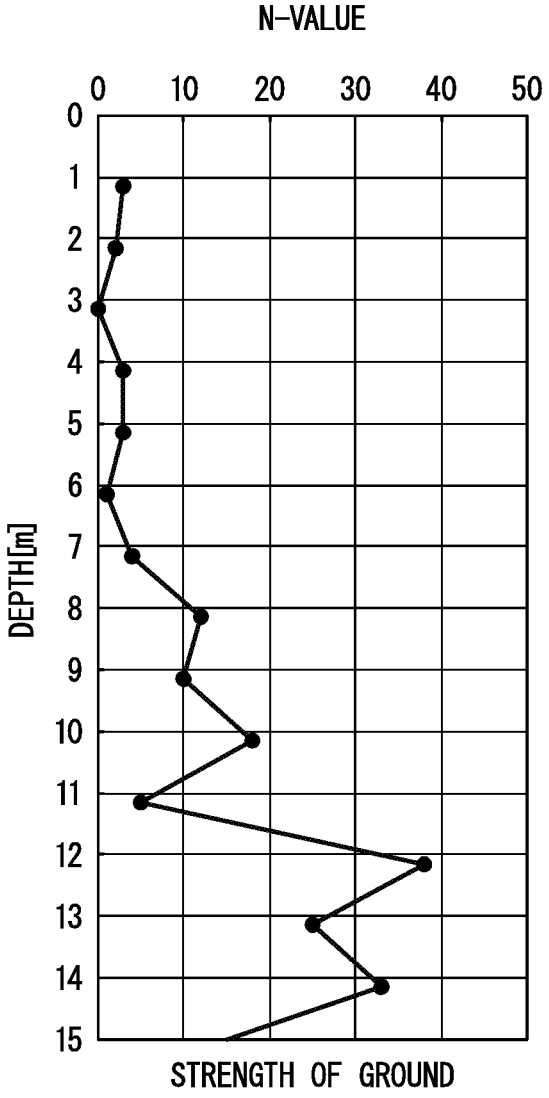
FIG. 7A is a diagram showing the relationship between the depth of the ground and the strength of the ground on which Test Example 2 is carried out.
Figure 7B:
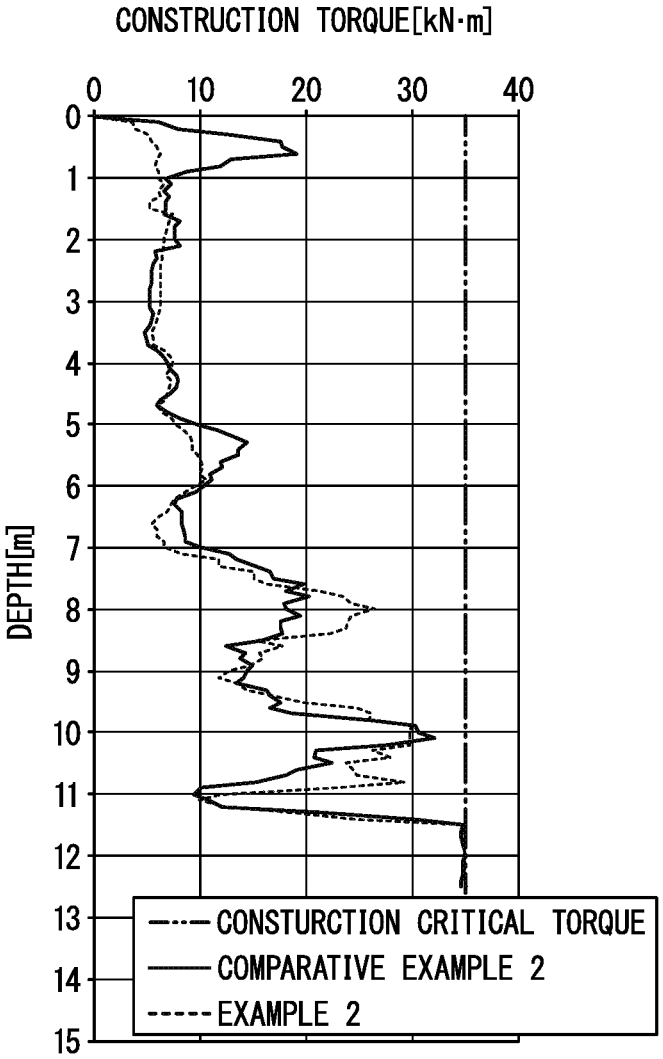
FIG. 7B is a diagram showing a measurement result of a construction torque in Test Example 2 by Example 2 and Comparative Example 2.

FIG. 7A is a diagram showing ground strength according to the depth of the ground. FIG. 7B is a graph showing the test results showing a construction torque, and the construction torques of Example 2 and Comparative Example 2 are almost equal to each other.

Figure 7C:
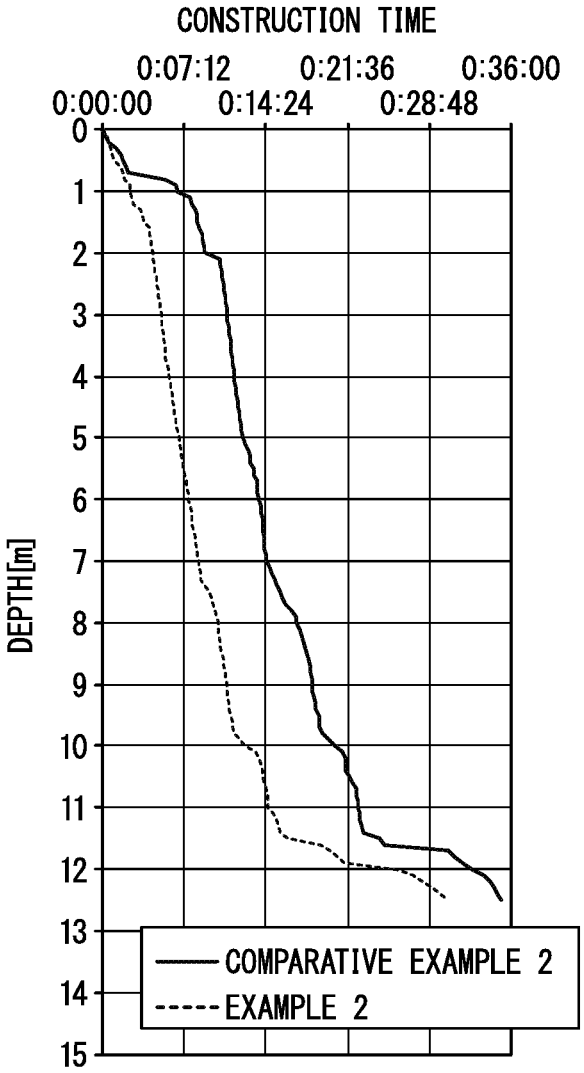
FIG. 7C is a diagram showing a measurement result of a construction time in Test Example 2.

Then, at the initial depth of about 0 to 1 m in depth, the construction torque of Comparative Example 2 rapidly increased, and thus the initial vertical propulsion ability was inferior. FIG. 7C shows construction time.

TABLE 2

| | | Construction time of each pile (min.) | Total construction time of piles (min.) | Support force of pile at reference displacement (kN) |
|---|---|---|---|---|
| Example 2 (with sectorial gap) | Upper pile (7.9 to 12.5 m) | 20 | 30 | About 1000 |
| | Intermediate piles (3.5 to 7.9 m) | 4.5 | | |
| | Lower pile (0 to 3.5 m) | 5.5 | | |
| Comparative Example 2 (without sectorial gap) | Upper pile (7.9 to 12.5 m) | 18 | 36 | About 650 |
| | Intermediate piles (3.5 to 7.9 m) | 6.5 | | |
| | Lower pile (0 to 3.5 m) | 11.5 | | |

Further, from Table 2, the construction time of the rotary press-in steel pipe pile 1 was 30 minutes in Example 2 and 36 minutes in Comparative Example 2, respectively. Further, the support force of the rotary press-in steel pipe pile 1 was about 1000 kN in Example 2 and about 650 kN in Comparative Example 2, respectively. For this reason, the support force of Example 2 was about 1.5 times that of Comparative Example 2.

According to Test Example 2, in FIG. 7B, in the area in which the depth was low and the ground strength was low, the construction torque in Comparative Example 2 was higher, and in the area in which the depth was high and the ground strength was high, the construction torque was a similar level in both examples.

Further, the total construction time shown FIG. 7C was considerably shorter in Example 2 than that in Comparative Example 2.

Further, in the test results shown in Table 2, the construction time in Example 2 was shorter by 0.76 times. Also with respect to the support force, the support force in Example 2 was higher.

According to the results of Test Example 2, Example 2 could exhibit a shorter construction time and higher construction ability than those in Comparative Example 2. Further, also with respect to the support force, in Example 2, a high support force of greater than or equal to 1.5 times that in Comparative Example 2 was obtained, and in particular, the construction performance at the early stage of drilling was excellent.

As described above, according to the rotary press-in steel pipe pile 1 of this embodiment, the following effects are exhibited.

(1) The first sectorial gap 6 of the lower blade 3 and the second sectorial gap 9 of the upper blade 4 are at positions opposite to each other in the circumferential direction of the steel pipe 2, and therefore, when the rotary press-in steel pipe pile 1 is rotationally driven into the ground, the drilling resistance by the cutting edge portion 7 of the first sectorial gap 6 and the drilling resistance by the cutting edge portion 10 of the second sectorial gap 9 are balanced, and furthermore, the drilled soil smoothly move due to the first sectorial gap 6 and the second sectorial gap 9, and thus a large propulsive force is obtained, whereby it is possible to improve the construction ability.

(2) Further, the central angle β of the second sectorial gap 9 is set to be smaller than the central angle α of the first sectorial gap 6, and therefore, the pressing force and the support force by the upper blade 4 are relatively large.

(3) Further, the outer diameter of the upper blade 4 is larger than the outer diameter of the lower blade 3, and therefore, due to a wedge effect, the drilling efficiency of the rotary press-in steel pipe pile 1 while drilling into the ground is good, and the ground can be pressed down, and thus the support force of the lower blade 3 in the vertical direction increases.

(4) Further, the opening 3*a* having a diameter smaller than the inner diameter of the steel pipe 2 is formed in the lower blade 3, the ring-shaped blocking plate 12 is provided inside of the steel pipe 2, and the small hole 12*a* is formed at the center. Therefore, soil can be introduced into the steel pipe 2, and thus drilling resistance is small. Furthermore, a buoyant force due to groundwater is reduced, and therefore, the construction ability is not reduced.

The present invention is not limited to the first embodiment described above, and appropriate changes, substitutions, or the like can be made within a scope which does not depart from the features of the present invention. Another embodiment or a modification example of the present invention will be described below, and the same or similar members, parts, and the like as or to those of the first embodiment described above are denoted by the same reference numerals and the description thereof is omitted.

For example, in the steel pipe 2 of the rotary press-in steel pipe pile 1 according to the first embodiment described above, the blocking plate 12 formed in a ring shape is fixed to the back side of the inside. However, it is not necessarily a ring shape, and an arbitrary blocking member such as a helical plate or a disk may be mounted. Also in a case of having such a configuration, since soil or the like intrude into the steel pipe 2 while drilling, it is possible to obtain a high supporting force. Further, in a case where groundwater or the like intrudes into the steel pipe 2, the buoyant force is reduced, and thus the construction ability can be improved.

Figure 8:
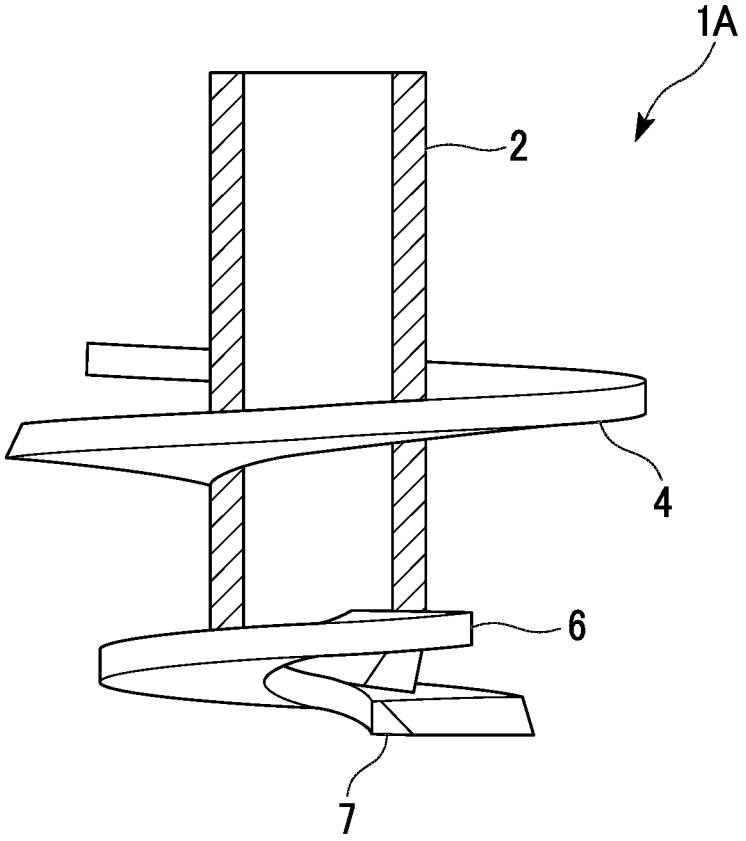
FIG. 8 is a sectional view similar to FIG. 2, showing a rotary press-in steel pipe pile according to a modification example.

Further, in a rotary press-in steel pipe pile 1A according to a first modification example shown in FIG. 8, the blocking plate 12 or the like may not be installed in the steel pipe 2, and even in the opened state, the propulsion ability is improved. Further, the distal end opening of the steel pipe 2 may be blocked with the lower blade 3.

(Second Embodiment)

Figure 9:
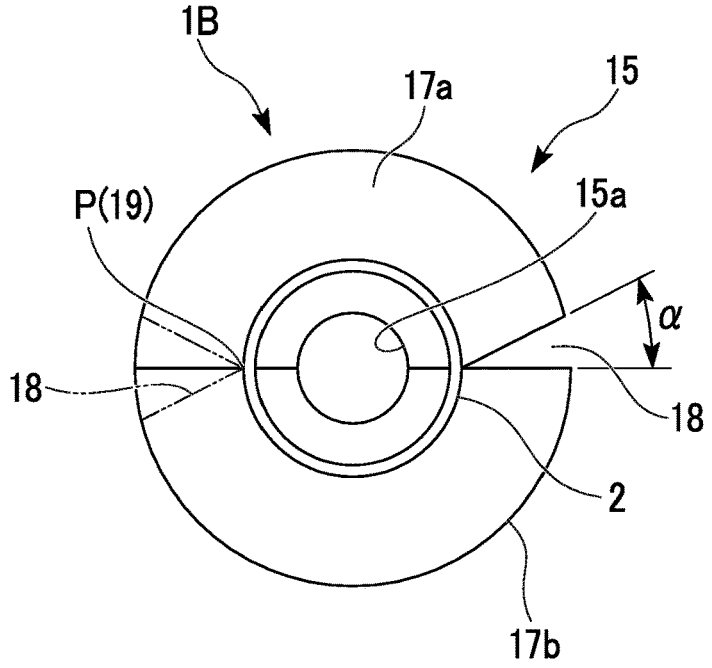
FIG. 9 is a plan view showing a first blade of a rotary press-in steel pipe pile according to a second embodiment.
Figure 10:
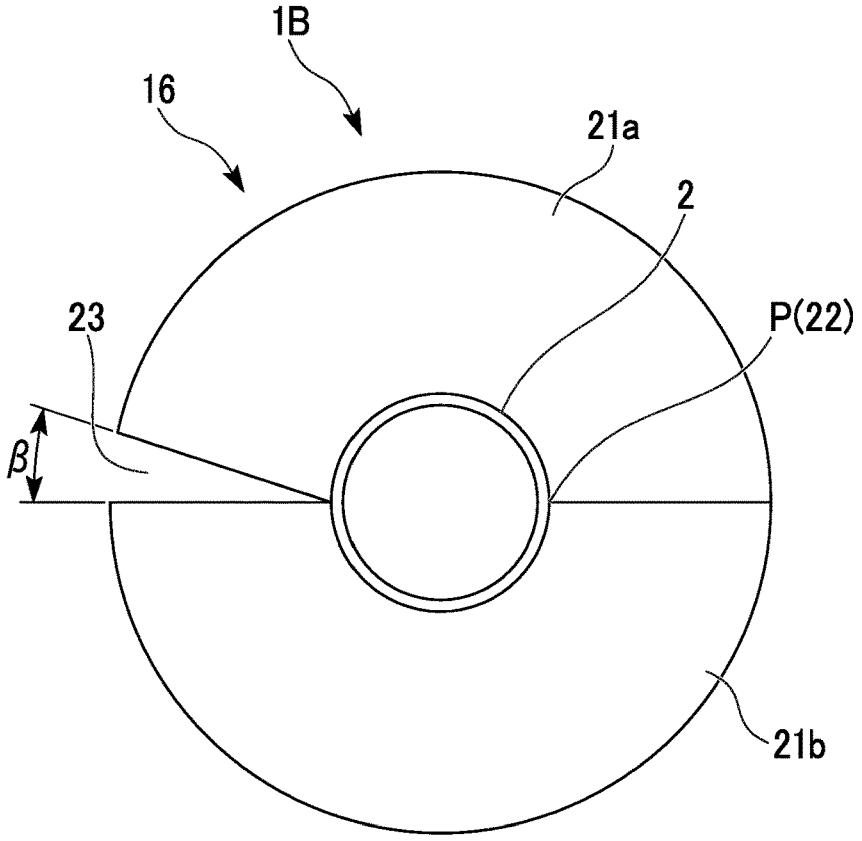
FIG. 10 is a plan view of a second blade.

Further, FIGS. 9 and 10 show a rotary press-in steel pipe pile 1B according to a second embodiment of the present invention. The rotary press-in steel pipe pile 1B according to the second embodiment is configured to include a lower blade 15 fixed to the distal end surface of the steel pipe 2, and an upper blade 16 fixed to the proximal end side of the steel pipe 2, similar to the rotary press-in steel pipe pile 1 according to the first embodiment described above. Further, the outer diameter of the upper blade 16 is set to be larger than the outer diameter of the lower blade 15.

As shown in FIG. 9, the lower blade 15 is composed of a plurality of blade portions, for example, two blade portions each having a substantially circular arc shape and a flat plate shape, in which one of the blade portions is referred to as a lower blade portion 17*a* and the other of the blade portions is referred to as an upper blade portion 17*b*. Both the blade portions 17*a* and 17*b* are fixed to cross each other in the longitudinal direction of the steel pipe 2 by welding or the like, for example, at a contact portion P with the steel pipe 2, and the fixing portion is referred to as a connection-fixing portion 19. The lower blade 15 provided on the distal end surface of the steel pipe 2 protrudes to the inside and the outside of the distal end opening of the steel pipe 2. Further, an opening 15*a* smaller than the inner diameter of the steel pipe 2 is formed by the inner peripheral edges of both the blade portions 17*a* and 17*b*.

The lower blade portion 17*a* is inclined downward with respect to a reference line orthogonal to the longitudinal direction of the steel pipe 2 and passing through the connection-fixing portion 19. Further, the upper blade portion 17*b* is inclined upward with respect to the reference line orthogonal to the steel pipe 2 and passing through the connection-fixing portion 19. For this reason, the lower blade 15 exhibits a substantially helically inclined shape by the lower blade portion 17*a* and the upper blade portion 17*b*. Further, at a lower end portion of the lower blade portion 17*a*, a tapered (that is, a circular-sectorial shape) first sectorial gap 18 having a central angle α spreading outward from the steel pipe 2 when viewed in a planar view is formed between the lower end portion and an end portion of the upper blade portion 17*b*, and a cutting edge portion (not shown) is formed on the end surface on the first sectorial gap 18 side of the lower blade portion 17*a*. For this reason, gaps are formed in the horizontal direction and the vertical direction at both end portions of the lower blade portion 17*a* and the upper blade portion 17*b*, which sandwich the first sectorial gap 18 therebetween.

The first sectorial gap 18 may be formed by cutting off the upper blade portion 17*b* or may be formed by cutting off both the lower blade portion 17*a* and the upper blade portion 17*b*.

Further, as shown in FIG. 10, the upper blade 16 is composed of a plurality of blade portions, for example, two blade portions each having a substantially circular arc shape and a flat plate shape, in which one of the blade portions is referred to as a lower blade portion 21*a* and the other of the blade portions is referred to as an upper blade portion 21*b*. Both the blade portions 21*a* and 21*b* are fixed to each other by welding or the like, for example, at the contact portion P with the steel pipe 2, and the fixing portion is referred to as a connection-fixing portion 22. Further, the connection-fixing portion 22 is provided at an angular position opposite to the connection-fixing portion 19 of the lower blade 15 when viewed in a planar view.

The lower blade portion 21*a* is inclined downward with respect to a reference line orthogonal to the longitudinal direction of the steel pipe 2 and passing through the connection-fixing portion 22. Further, the upper blade portion 21*b* is inclined upward with respect to the reference line orthogonal to the steel pipe 2 and passing through the connection-fixing portion 22. For this reason, the upper blade 16 is inclined in a substantially helical shape by the lower blade portion 21*a* and the upper blade portion 21*b*. Further, at a lower end portion of the lower blade portion 21*a*, a second sectorial gap 23 having a central angle β (β<α) spreading outward from the steel pipe 2 when viewed in a planar view is formed between the lower end portion and an end portion of the upper blade portion 21*b*, and a cutting edge portion (not shown) is formed on the end surface on the second sectorial gap 23 side of the lower blade portion 21*a*. For this reason, gaps are formed in the horizontal direction and the vertical direction at both end portions of the lower blade portion 21*a* and the upper blade portion 21*b*, which sandwich the second sectorial gap 23 therebetween.

The second sectorial gap 23 may be formed by cutting off the upper blade portion 21*b* or may be formed by cutting off both the lower blade portion 21*a* and the upper blade portion 21*b*.

For this reason, also in the rotary press-in steel pipe pile 1B according to the second embodiment, when the rotary press-in steel pipe pile 1B is rotationally driven into the ground, the ground is drilled by the cutting edge portion facing the first sectorial gap 18 of the lower blade portion 17*a* in the lower blade 15 having a substantially helical shape and the ground is drilled by the cutting edge portion facing the second sectorial gap 23 of the lower blade portion 21*a* in the upper blade 16 having a substantially helical shape. Then, the soil drilled by each of the cutting edge portions of the lower blade 15 and the upper blade 16 smoothly moves upward through each of the first sectorial gap 18 and the second sectorial gap 23.

Furthermore, the first sectorial gap 18 of the lower blade 15 and the second sectorial gap 23 of the upper blade 16 are located at positions opposite to each other in the circumferential direction of the steel pipe 2, and therefore, the drilling resistance by the cutting edge portion of the first sectorial gap 18 and the drilling resistance by the cutting edge portion of the second sectorial gap 23 are opposed to each other, and thus construction can be performed in a well-balanced manner.

Further, the central angle β of the second sectorial gap 23 is set to be smaller than the central angle α of the first sectorial gap 18, and therefore, the support force of the rotary press-in steel pipe pile 1B by the upper blade 4 is high.

Furthermore, the outer diameter of the upper blade 16 is larger than the outer diameter of the lower blade 15, and therefore, the drilling efficiency of the rotary press-in steel pipe pile 1B while drilling into the ground is excellent, and the support force in the vertical direction increases. Further, the opening 15*a* of the lower blade 15 is formed in the distal end opening of the steel pipe 2, and therefore, propulsion resistance is small, and in addition, the action of the buoyant force by groundwater or the like is reduced, and therefore, the construction ability is not reduced.

In each of the embodiments described above, the lower blade 3 or 15 and the upper blade 4 or 16 are formed in a substantially helical shape and the first sectorial gap 6 or 18 and the second sectorial gap 9 or 23 each having a substantially tapered shape (that is, a circular-sectorial shape) when viewed in a planar view between the divided end portions are respectively formed at positions opposite to each other by approximately 180 degrees. However, as long as the first sectorial gap 6 or 18 and the second sectorial gap 9 or 23 are disposed at positions that do not overlap each other, the positions need not be opposite to each other.

Further, in each of the lower blade 3 or 15 and the upper blade 4 or 16, the location where each of the first sectorial gap and the second sectorial gap is formed is not limited to a single location and may be divided into a plurality of locations, and a cutting edge portion may be provided at each of the locations. In this case, although the support force of each blade 3, 4, 15, or 16 is lowered, the construction ability is further improved.

For example, each of the lower blade 15 and the upper blade 16 in the second embodiment may be formed by combining three or more blade portions, instead of the configuration in which each blade is composed of two lower and upper blade portions. Further, in each of two or three or more blades, each of the first sectorial gap and the second sectorial gap is not limited to a single sectorial gap and two or more sectorial gaps may be formed at the central angle α or β having an arbitrary size between the respective blade portions (for example, refer to the first sectorial gap 18 indicated by a two-dot chain line in FIG. 9). In this case, it is most preferable that the first sectorial gap 6 or 18 and the second sectorial gap 9 or 23 be disposed so as not to overlap each other. However, in terms of the balance between the construction ability and the support force, it is preferable that at least the first sectorial gap 18 having the largest central angle α of the lower blade 15 and the second sectorial gap 23 having the smallest central angle β of the upper blade 16 be disposed so as not to overlap each other.

Further, in the rotary press-in steel pipe pile 1, 1A, or 1B described above, a configuration is made in which as helical blades, two blades, the lower blade 3 or 15 and the upper blade 4 or 16, are disposed and the first sectorial gap 6 or 18 and the second sectorial gap 9 or 23 are provided at positions opposing each other by approximately 180 degrees. However, as each blade, three or more blades may be installed in the longitudinal direction of the steel pipe 2, and in that case, it is preferable that the sectorial gaps of the blades of each stage be installed at substantially spaced positions obtained by substantially dividing 360 degrees of the entire circumference by the number of blades. However, the sectorial gaps may be installed at irregular intervals.

In a case where a plurality of blades are installed in the longitudinal direction of the steel pipe 2, as long as the projected area of the plurality of blades disposed around the steel pipe 2 when viewed in a planar view is not changed, the support force of the rotary press-in steel pipe pile 1 does not change even if the sectorial gaps of the respective blades are not arranged at equal intervals. Even in that case, the support force is constant. However, there is a possibility that the construction performance of the pressure drilling may be slightly reduced.

Further, the lower blade and the upper blade may be a combination of either one of the lower blade 3 or 15 and the upper blade 4 or 16 of different types according to the first and second embodiments with the other. Further, in each embodiment, the distal end opening of the steel pipe 2 may be blocked by the lower blade 3 or 15 or may be opened.

In the present invention, the lower blade 3 or 15 configures a first blade, and the upper blade 4 or 16 configures a second blade.

INDUSTRIAL APPLICABILITY

The present invention relates to a rotary press-in steel pipe pile with helical blades mounted on a distal end of a steel pipe. According to the present invention, it is possible to provide a rotary press-in steel pipe pile which can be smoothly driven into the ground, and thus the construction ability is high, and the support force is large.

EXPLANATION OF REFERENCE SIGNS

1: rotary press-in steel pipe pile
2: steel pipe
3, 15: lower blade
3*a*: opening
4, 16: upper blade
6, 18: first sectorial gap
7, 10: cutting edge portion
9, 23: second sectorial gap
12: blocking plate
17*a*, 21*a*: lower blade portion
17*b*, 21*b*: upper blade portion

The invention claimed is:

1. A rotary press-in steel pipe pile, comprising:

A steel pipe;

A first blade which is formed in a substantially helical shape on the steel pipe so as to be positioned close to a distal end of the steel pipe and in which a first sectorial gap having a central angle is formed between an upper end portion and a lower end portion of the first blade when viewed from a distal end side of the steel pipe pile in an axial direction thereof; and A second blade which is formed in a substantially helical shape on the steel pipe so as to be positioned close to a rear end of the steel pipe with respect to the first blade and in which a second sectorial gap having a central angle is formed between an upper end portion and a lower end portion of the second blade when viewed from the distal end side of the steel pipe pile in an axial direction thereof, wherein The first sectorial gap of the first blade and the second sectorial gap of the second blade are disposed at positions that do not overlap in a circumferential direction, and the central angle of the second sectorial gap is set to be smaller than the central angle of the first sectorial gap.

2. The rotary press-in steel pipe pile according to claim 1, wherein the first sectorial gap and the second sectorial gap are formed at positions substantially spaced in the circumferential direction across the steel pipe.

3. The rotary press-in steel pipe pile according to claim 1, wherein an outer diameter of the second blade is formed to be larger than an outer diameter of the first blade.

4. The rotary press-in steel pipe pile according to claim 1, wherein an opening having a smaller diameter than a distal end opening of the steel pipe is formed in the first blade, and the opening is formed to communicate with the first sectorial gap.

5. The rotary press-in steel pipe pile according to claim 1, wherein a ring-shaped or disk-shaped blocking member that restricts introduce of soil is mounted inside of the steel pipe.

6. The rotary press-in steel pipe pile according to claim 2, wherein an outer diameter of the second blade is formed to be larger than an outer diameter of the first blade.

7. The rotary press-in steel pipe pile according to claim 2, wherein an opening having a smaller diameter than a distal end opening of the steel pipe is formed in the first blade, and the opening is formed to communicate with the first sectorial gap.

8. The rotary press-in steel pipe pile according to claim 3, wherein an opening having a smaller diameter than a distal end opening of the steel pipe is formed in the first blade, and the opening is formed to communicate with the first sectorial gap.

9. The rotary press-in steel pipe pile according to claim 2, wherein a ring-shaped or disk-shaped blocking member that restricts introduce of soil is mounted inside of the steel pipe.

10. The rotary press-in steel pipe pile according to claim 3, wherein a ring-shaped or disk-shaped blocking member that restricts introduce of soil is mounted inside of the steel pipe.

11. The rotary press-in steel pipe pile according to claim 4, wherein a ring-shaped or disk-shaped blocking member that restricts introduce of soil is mounted inside of the steel pipe.

* * * * *